US006334806B1

(12) United States Patent
Sano et al.

(10) Patent No.: US 6,334,806 B1
(45) Date of Patent: Jan. 1, 2002

(54) APPARATUS FOR AND A METHOD OF MACHINING TWO PORTIONS

(75) Inventors: Shoichi Sano, Gamagori; Masahiro Ido, Kariya; Satoshi Yamaguchi, Aichi-ken, all of (JP)

(73) Assignee: Toyoda Koki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/407,762

(22) Filed: Sep. 29, 1999

(30) Foreign Application Priority Data

Sep. 29, 1998 (JP) ..... 10-275804

(51) Int. Cl.[7] ..... B24B 5/42
(52) U.S. Cl. ..... 451/5; 451/249
(58) Field of Search ..... 451/62, 14, 5, 451/142, 249, 49, 399

(56) References Cited

U.S. PATENT DOCUMENTS 2,054,364 A * 9/1936 De Leeuw ..... 451/249
5,367,866 A * 11/1994 Phillips ..... 451/304
5,951,377 A * 9/1999 Vaughn et al. ..... 451/5

FOREIGN PATENT DOCUMENTS

JP 347027312 * 7/1972 ..... 451/249
JP 54-71495 6/1979
JP 56-18325 4/1981

* cited by examiner

*Primary Examiner*—Robert A. Rose
(74) *Attorney, Agent, or Firm*—Oblon, Spivak, McClelland, Maier & Neustadt, P.C.

(57) ABSTRACT

A grinding machine includes a spindle head for rotatably driving a crankshaft around a journal center as a rotational axis and, two wheel heads that support respective two grinding wheels and that advance and retract in a direction perpendicular to the rotational axis independently with each other. Two of plural pin portions of the rotating crankshaft are simultaneously ground by the respective two grinding wheels, in which rotational phases of the two pin portions are different from each other. Further, the rotational phases of the two pin portions are stored as a combination in a memory. The two pin portions are simultaneously ground in accordance with the combination by the respective two grinding wheels.

3 Claims, 7 Drawing Sheets

FIG. 3
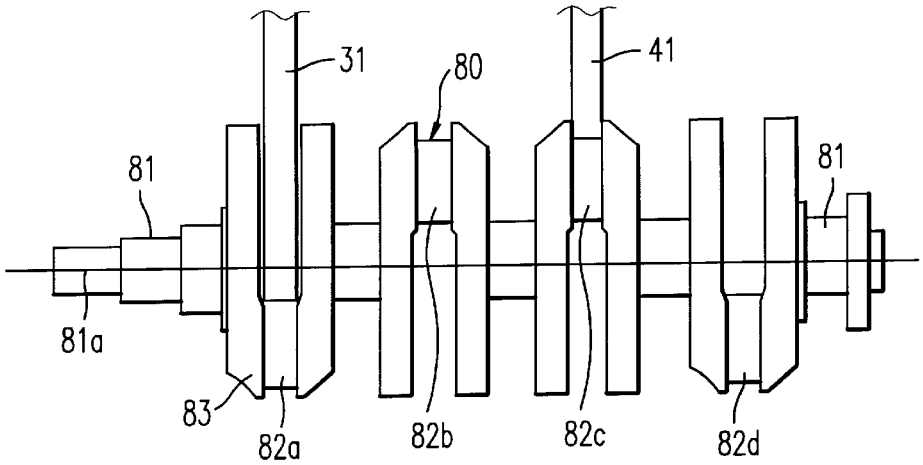
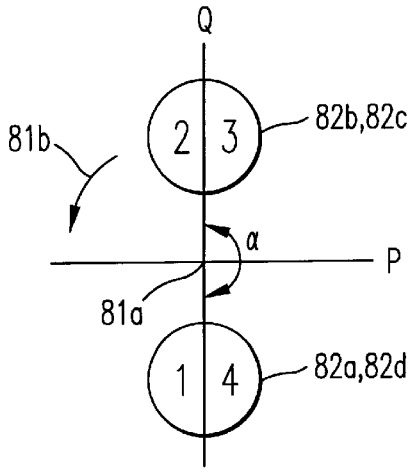
FIG. 4
FIG. 5
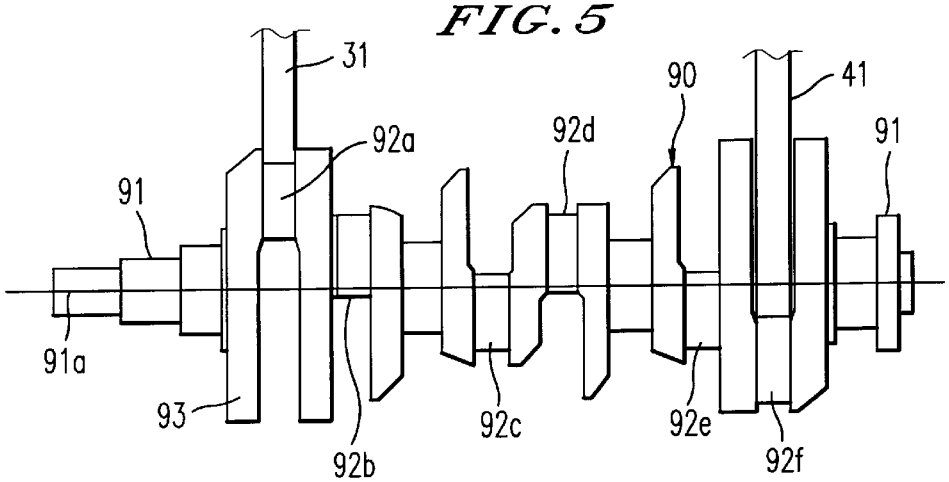

| GRINDING PROCESS | WORKPIECE NO.1 | WORKPIECE NO.2 | WORKPIECE NO.3 |
|---|---|---|---|
| 1 | 1 , 3 | 1 , 6 | 1 , 4 |
| 2 | 2 , 4 | 2 , 3 | 2 , 6 |
| 3 | | 4 , 5 | 3 , 5 |
| 4 | | | |

*FIG. 10*

| | VARIETY OF CRANKSHAFT | ROTATIONAL PHASE IN PIN PORTIONS | COMBINATION OF PIN PORTIONS IN SIMULTANEOUS MACHINING OPERATIONS |
|---|---|---|---|
| (A) | STRAIGHT 3-CYLINDER ENGINE 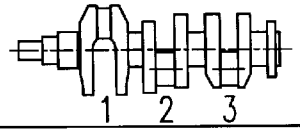  | 1 + 2 3 | FIRST GRINDING OPERATION: 1st & 3rd PINS<br>SECOND GRINDING PROCESS: 2nd PIN ONLY |
| (B) | STRAIGHT 5-CYLINDER ENGINE 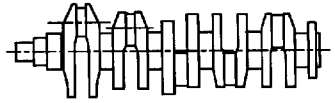  | 1 5 + 2 4 3 | FIRST GRINDING OPERATION: 1st & 4th PINS<br>SECOND GRINDING PROCESS: 2nd & 5th PINS<br>THIRD GRINDING PROCESS: 3rd PIN ONLY |
| (C) | V-TYPE 6-CYLINDER ENGINE 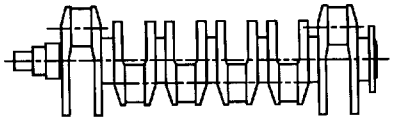  | 1,6 + 2,5 3,4 | FIRST GRINDING OPERATION: 1st & 4th PINS<br>SECOND GRINDING PROCESS: 2nd & 6th PINS<br>THIRD GRINDING PROCESS: 3rd & 5th PINS |
| (D) | MODULATED V-TYPE 6-CYLINDER ENGINE 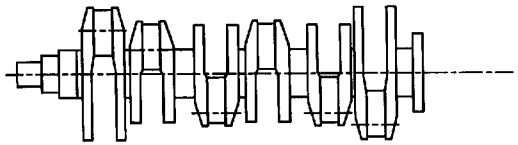  | 2 1 + 5 6 3 4 | FIRST GRINDING OPERATION: 1st & 4th PINS<br>SECOND GRINDING PROCESS: 2nd & 6th PINS<br>THIRD GRINDING PROCESS: 3rd & 5th PINS<br>FIRST GRINDING OPERATION: 1st & 4th PINS<br>SECOND GRINDING PROCESS: 2nd & 6th PINS<br>THIRD GRINDING PROCESS: 3rd & 5th PINS |

APPARATUS FOR AND A METHOD OF MACHINING TWO PORTIONS

BACKGROUND OF THE INVENTION

1. Field of the Invention

The present invention relates to an apparatus for and a method of grinding a crankshaft, more particularly, to an apparatus for and a method of preventing a machining accuracy from deteriorating by restraining a load fluctuation acting on a main spindle when grinding pin portions of a crankshaft.

2. Description of the Related Art

Since a pin portion of a crankshaft used in an engine is rotatably connected to a connecting rod, it is required to accurately machine the pin portion in its radial dimension and roundness.

As disclosed in Japanese Patent Publication (Kokai) No. S54(1979)-71495, it is known such a grinding machine that grinds a pin portion of one crankshaft eccentrically moving around a journal portion as a rotational center, in which two wheel heads are independently advanced and retracted synchronously with a rotation of a main spindle.

In such a conventional grinding machine, the pin portion revolves around the rotational center of the journal portion eccentrically by an eccentric distance between the rotational center of the journal center and a center of the pin portion. Namely, as shown in FIG. 9, a rotational direction of the pin portion relative to a normal component of a grinding resistance changes during a grinding operation either in a case that the pin portion exists at a position represented by (a) in FIG. 9 or in a case that the pin portion exists at a position represented by (b) in FIG. 9. In another words, at the position (a) the grinding resistance acts on the pin portion in a same direction as the rotational direction of the pin portion and however, at the position (b) it acts thereon in a reverse direction relative to the rotational direction of the pin portion. Therefore, there is such a demerit that a grinding accuracy is deteriorated by a load fluctuation acting on the main spindle.

SUMMARY OF THE INVENTION

Accordingly, an object of the present invention is to solve the above mentioned problems and is to provide a machining method for grinding pin portions of a crankshaft in which a deterioration is prevented in a machining accuracy of the pin portions by restraining a load fluctuation acting on a main spindle rotating the crankshaft.

Briefly, according to the present invention, two pin portions of one rotating crankshaft having different rotational phase are respectively ground by respective two grinding wheels which are controllably moved synchronously with a rotation of the crankshaft in accordance with pin portion data. In the pin portion data, the two pin portions to be ground simultaneously are memorized as a combination. The two pin portions are different from each other in rotational phase, so that directions of grinding resistance acting on the respective pin portions are also different from each other, Therefore, a load fluctuation acting on a main spindle can be reduced compared with either case that only one pin portion is ground or case that two pin portions having the same rotational phase are simultaneously ground.

Further, a rotational phase difference between the two pin portions in the combination is set as 180°. In a case that the grinding wheels on the wheel heads rotate in the same condition, the grinding resistances act on the two pin portions by the same amount in positive and negative directions. Accordingly, the grinding resistances can be almost canceled in each other, so that loads acting on the main spindle by the grinding resistances can be almost canceled also, whereby load fluctuation acting thereon can be reduced. Therefore, grinding accuracy (i.e., roundness) on the two pin portions can be improved. Even if a rotational phase difference between the two pin portions in the combination is set as 60° or 120°, the grinding resistances can be reduced in each other, so that loads acting on the main spindle by the grinding resistances can be also reduced.

The load fluctuation acting on the main spindle can be reduced, so that the grinding accuracy (i.e., roundness) on the two pin portions can be improved compared with either case that only one pin portion is ground or case that two pin portions having the same rotational phase are simultaneously ground. The combination of the two pin portions to be simultaneously ground can be freely changed in a condition that the rotational phase difference is set as 60° or 120°. Even if the adjacent two pin portions cannot be simultaneously ground due to the machine construction, the grinding accuracy (i.e., roundness) on the two pin portions can be improved by changing the combination of the two pin portions.

Furthermore, a process table is provided in the memory, in which the combination of the two pin portions and a workpiece No. designating variety of the crankshafts are related, so that a machining process is determined based upon the process table. Therefore, the two pin portions having the different rotational phases can be automatically ground by designating the workpiece No.

BRIEF DESCRIPTION OF THE ACCOMPANYING DRAWINGS

Various other objects, features and many of the attendant advantages of the present invention will be readily appreciated as the same becomes better understood by reference to the following detailed description of the preferred embodiments when considered in with the accompanying drawings, in which:

FIG. 3 is an explanatory chart for grinding pin portions of a crankshaft used in a straight four-cylinder engine according to the present invention;

FIG. 4 is an explanatory chart showing a phase relationship between each of pin portions of a crankshaft in FIG. 3;

Figures 6, 7:
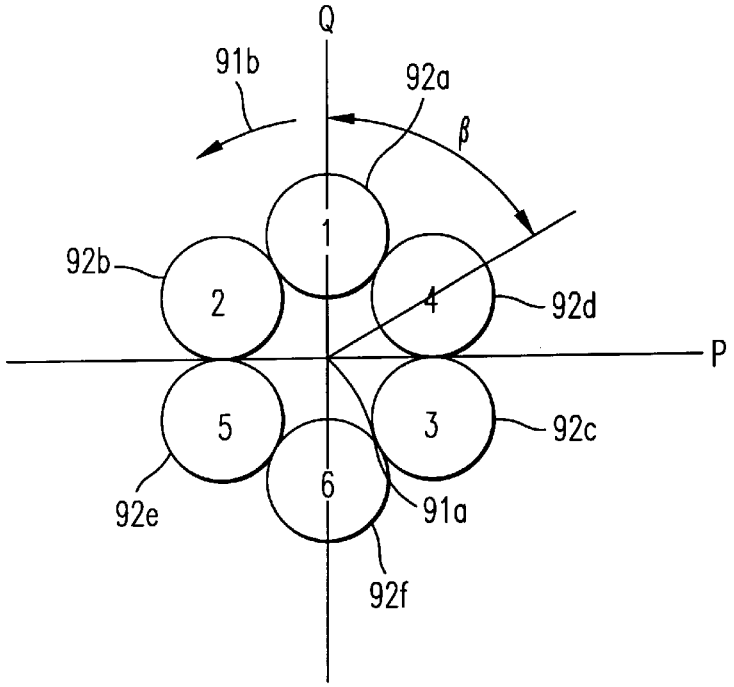
Figure 8:
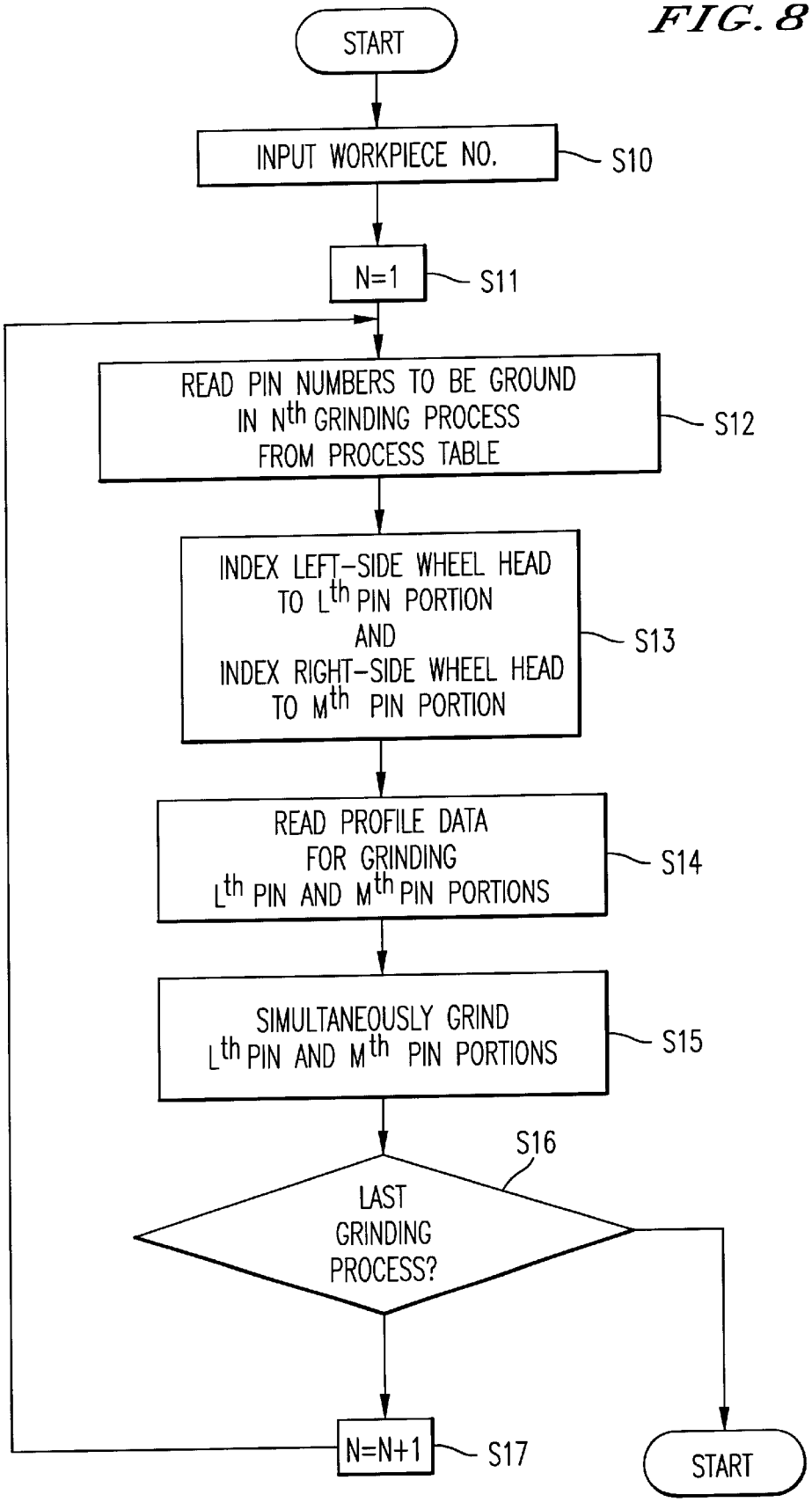
Figure 9:
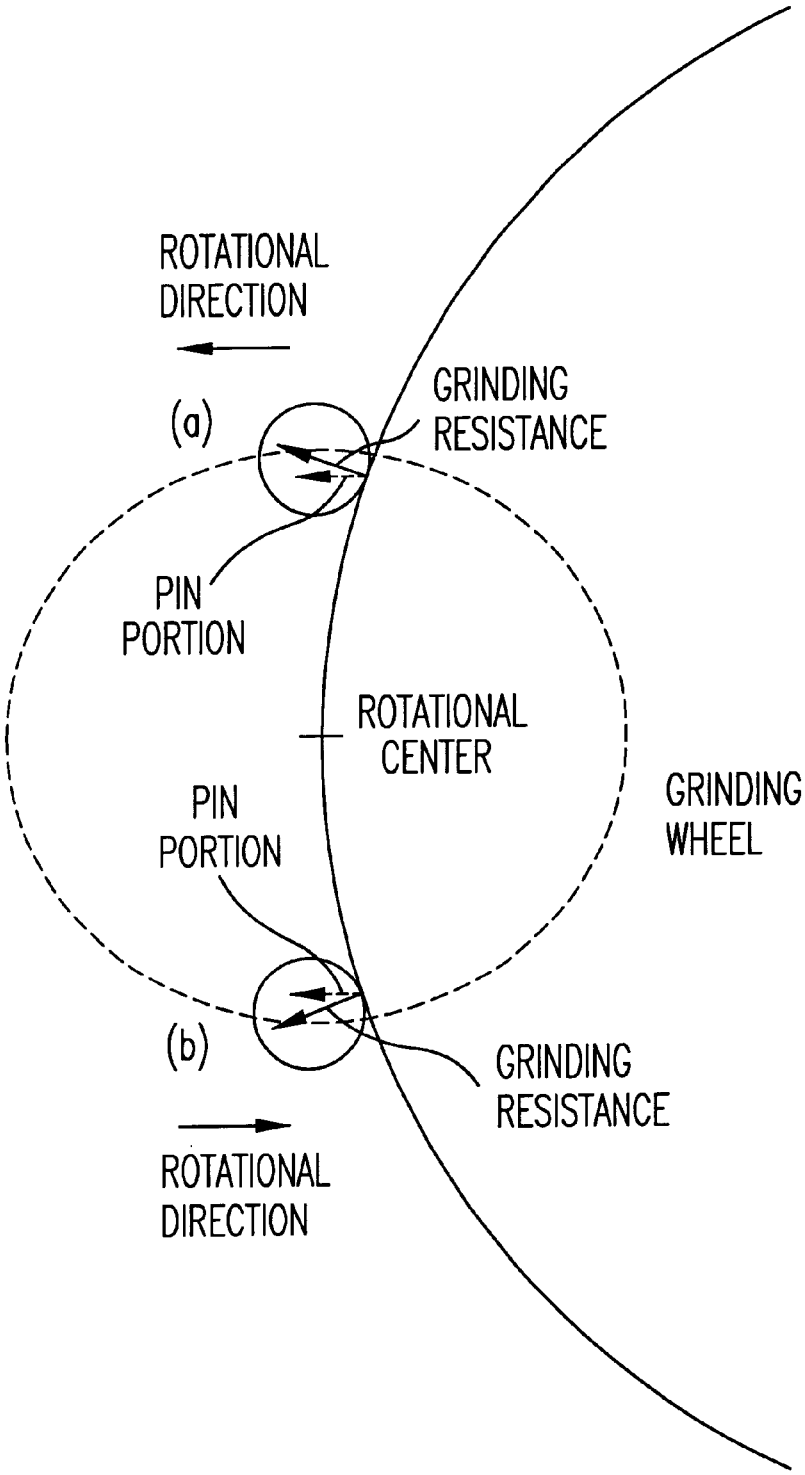

FIG. 5 an explanatory chart for grinding pin portions of a crankshaft used in a V-type six-cylinder engine according to the present invention;

FIG. 6 is an explanatory chart showing a phase relationship between each of pin portions of a crankshaft in FIG. 5;

FIG. 7 shows a table for grinding pin portions of a crankshaft according to the present invention;

FIG. 8 is a flowchart showing a machining program according to the present invention;

FIG. 9 is an explanatory chart showing a relationship between a rotation of a main spindle and a load acting on a main spindle by a grinding resistance; and FIG. 10 is an explanatory chart showing a machining method in the others of a crankshaft according to the present invention.

DETAILED DESCRIPTION OF THE PREFERRED EMBODIMENT

Figure 1:
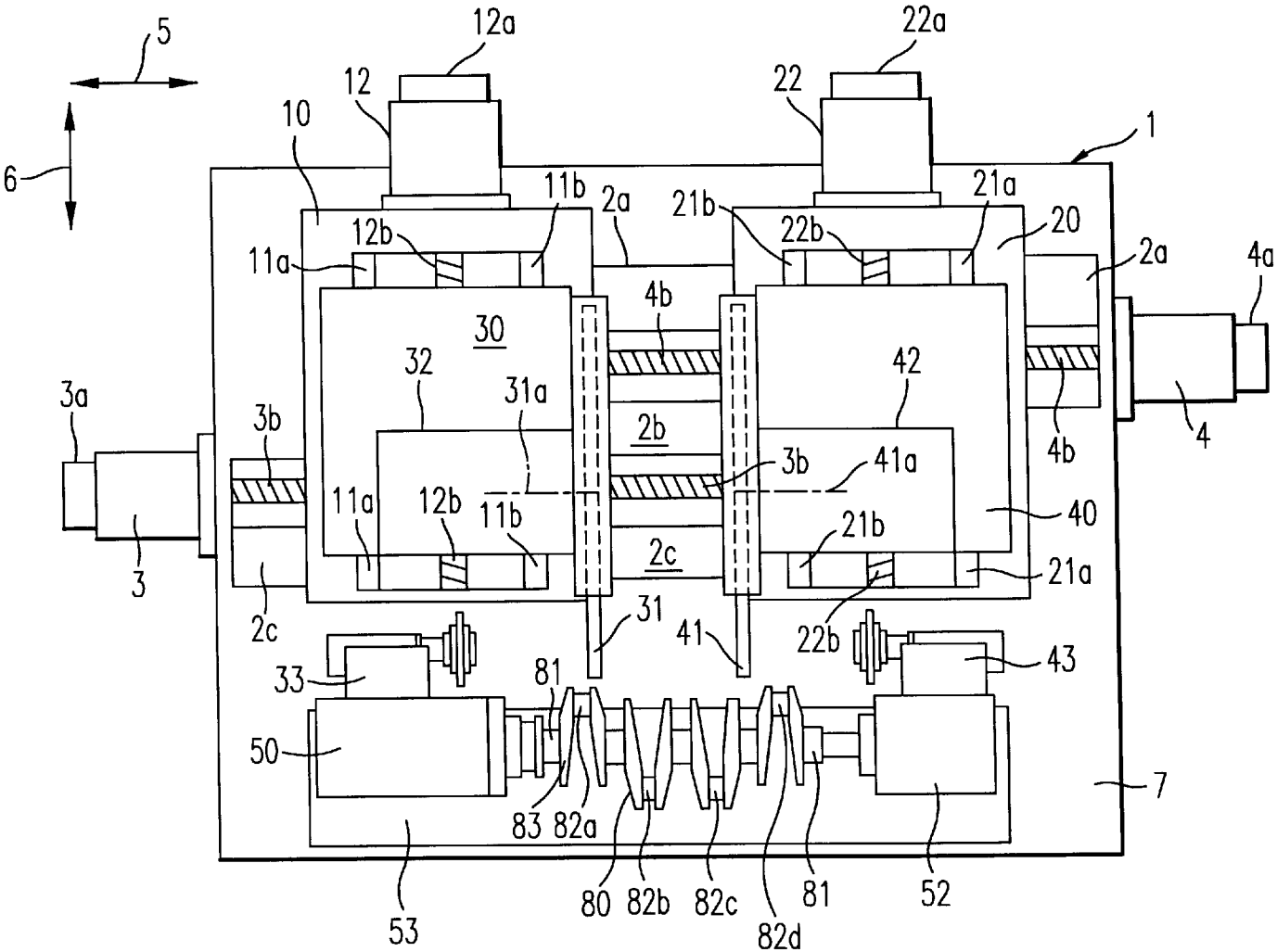
FIG. 1 is a top plane view of a machine tool according to the present invention.

An embodiment according to the present invention will be described hereinafter with reference to the drawings. FIG. 1 shows a top plane view of a grinding machine according to the present invention, and FIG. 2 shows a block diagram of a numerical control unit according thereto.

Figure 2:
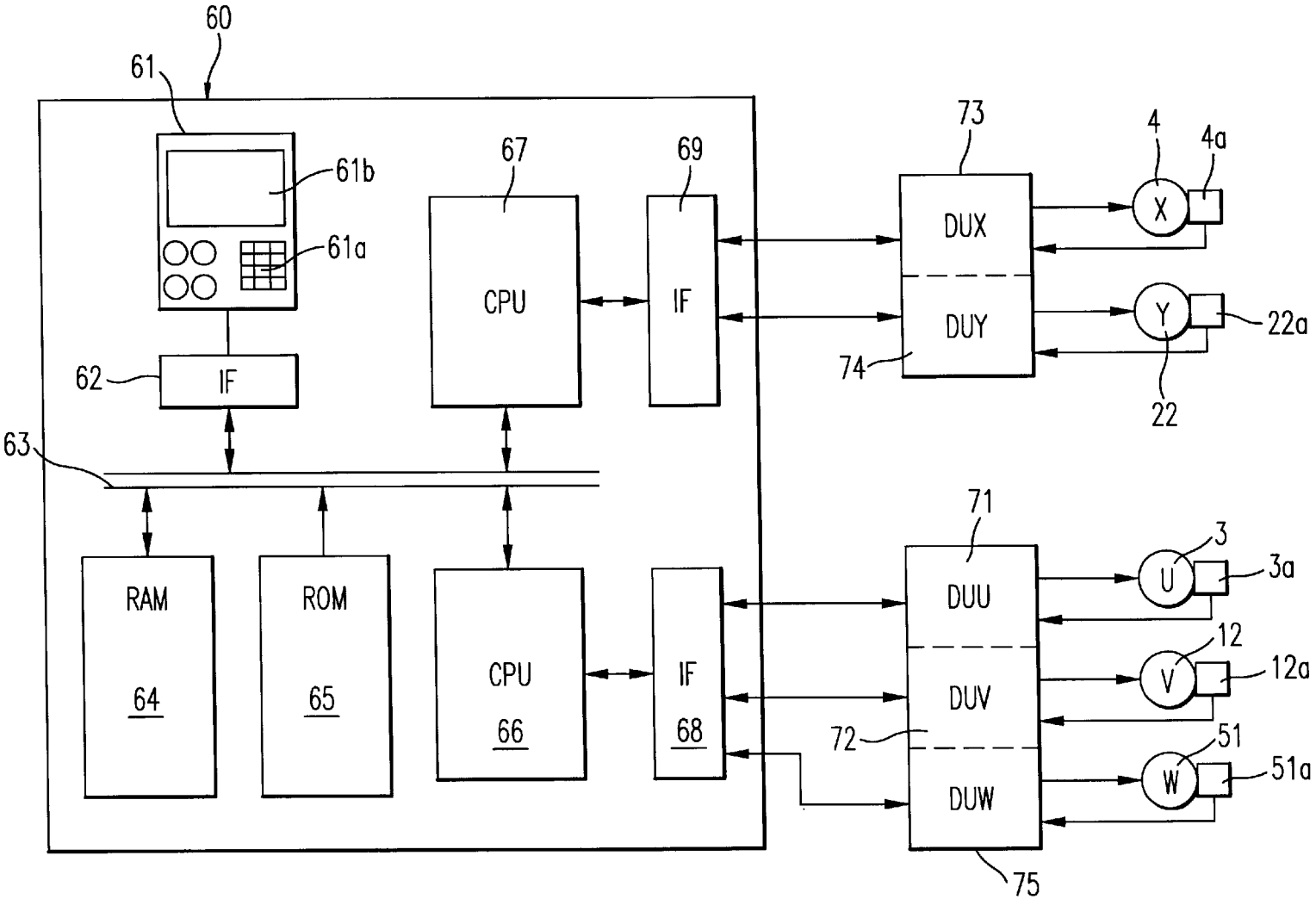
FIG. 2 is block diagram of a numerical control unit according to the present invention.

In FIGS. 1 and 2, Z-axis guide rails 2*a*, 2*b* and 2*c* are secured to a base 7 of a grinding machine 1. Further, a left-side table motor 3 is fixed on the base 7, to which a ball screw is rotatably connected. On the other hand, a right-side table motor 4 is fixed on the base 7, to which a ball screw 4*a* is rotatably connected. An encoder 3*a* is attached to the left-side table motor 3 to detect a rotational position thereof, while an encoder 4*a* is attached to the right-side table motor 4 to detect a rotational position thereof A left-side table 10 and a right-side table 20 are slidably arranged along the axis Z-rails 2*a*, 2*b* and 2*c* in a Z-axis direction (direction indicated by an arrow 5). On the left-side table 10, there are arranged fixed pair of rails 11*a* and 11*b*, a left-side wheel head motor 12 and a ball screw 12*b*, in which an encoder 12*a* is attached to the left-side wheel head motor 12 to detect a rotational position thereof. Similarly, on the right-side table 20, there are arranged pair of rails 21*a* and 21*b*, a right-side wheel head motor 22 and a ball screw 22*b*, in which an encoder 22*a* is attached to the right-side wheel head motor 22 to detect a rotational position thereof.

A left-side wheel head 30 is slidably arranged along the rails 11*a* and 11*b* in an X-axis direction (direction indicated by an arrow 6), on which a grinding wheel 31 is mounted. The grinding wheel 31 takes the form of a disc and is rotated at a high rotational speed by a wheel motor 32 disposed on the wheel head 30. Besides, 31*a* denotes a rotational center axis of the grinding wheel 31.

On the other hand, a right-side wheel head 40 is slidably mounted along the rails 21*a* and 21*b* in the X-axis direction, on which a grinding wheel 41 is mounted. The grinding wheel 41 takes the form of a disc and is rotated by a wheel motor 42 at the same high rotational speed as that of grinding wheel 31. Similarly, 41*a* denotes a rotational center axis of the grinding wheel 41.

A work head 50 and a tailstock 52 are arranged on a worktable 53 fixed on the base 7. A workpiece such a crank shaft 80 is rotatably held at a journal portion 81 thereof around a center axis of the journal portion 81 by the work head 50 and the tailstock 52. The crank shaft 80 is rotated as described above by a main spindle motor 51 (refer to FIG. 2) arranged on the work head 50. On the main spindle motor 51, there is attached an encoder 51*a* to detect a rotational position of the main spindle motor 51.

A truing device 33 is fixed on the spindle head 50 for truing a grinding surface of the grinding wheel 31, while a truing device 43 is fixed on the tailstock 52 for truing a grinding surface of the grinding wheel 41.

In a numerical control unit 60 (refer to FIG. 2), there are provided an input device 61, a signal bus line 63, a RAM 64, a ROM 65, a CPU 66 for controlling the left-side table 10, wheel head 30 and a main spindle of the spindle head 50, a CPU 67 for controlling the right-side table 20 and wheel head 40, and interfaces (IFs) 62, 68 and 69. The input device 61 is composed of a key input section 61*a* and a display section 61*b*, and is connected to the signal bus line 63 through the interface (IF) 62. Further, the RAM 64, ROM 65 and CPUs 66 and 67 are connected with each other through the signal bus line 63.

A motor control circuit 71 for controlling the left-side Z-axis table motor 3 is connected to the CPU 66 via the interface (IF) 68, to which an output from the encoder 3*a* is feedbacked as a detected angle position (rotational position) of the left-side Z-axis table motor 3. The left-side Z-axis table motor 3 can be controlled by the motor control circuit 71 so as to make zero a difference between a detected value of the encoder 3*a* and a target value in the rotational position of the left-side Z-axis table motor 3.

Further, a motor control circuit 72 for controlling the left-side wheel head motor 12 is connected to the CPU 66 via the interface (IF) 68, to which an output from the encoder 12*a* is feedbacked as a detected angle position (rotational position) of the left-side wheel head motor 12. The left-side wheel bead motor 12 can be controlled by the motor control circuit 72 so as to make zero a difference between a detected value of the encoder 12*a* and a target value in the rotational position of the left-side wheel head motor 12.

Furthermore, a motor control circuit 73 for controlling the right-side Z-axis table motor 4 is connected to the CPU 67 via the interface (IF) 69, to which an output from the encoder 4*a* is feedbacked as a detected angle position (rotational position) of the right-side Z-axis table motor 4. The right-side Z-axis table motor 4 can be controlled by the motor control circuit 73 so as to make zero a difference between a detected value of the encoder 4*a* and a target value in the rotational position of the right-side Z-axis table motor 4.

Moreover, a motor control circuit 74 for controlling the right-side wheel head motor 22 is connected to the CPU 67 via the interface (IF) 69, to which an output from the encoder 4*a* is feedbacked as a detected angle position (rotational position) of the right-side wheel head motor 12. The right-side wheel head motor 12 can be controlled by the motor control circuit 74 so as to make zero a difference between a detected value of the encoder 12*a* and a target value in the rotational position of the right-side wheel head motor 12.

Similarly, a motor control circuit 75 for controlling a main spindle motor S1 is connected to the CPIJ 66 via the interface (IF) 69, to which an output from the encoder 51*a* is feedbacked as a detected angle position (rotational position) of the main spindle motor 51. The main spindle motor 51 can be controlled by the motor control circuit 75 so as to make zero a difference between a detected value of the encoder 51*a* and a target value in the rotational position of the main spindle motor 51.

In the event that a power supply switch of the grinding machine 1 is turned on and that machining data for the crankshaft is input through the key section 61 a of the input device 61, the machining data therefor is memorized in the RAM 64. Next, after the grinding wheels 31 and 41 are operated (rotated), the motor control circuits 71–75 are respectively controlled in accordance with the machining data memorized in the RAM 64 and programs stored in the ROM 65 by the CPUs 66 and 67, so that the motors 3, 4, 12, 22 and 51 can be controllably rotated with the motor control circuits 71–75, respectively.

The grinding wheel 31 is movable in the Z-axis direction upon rotation of the motor 3, and is retractably advanced in the X-axis direction upon rotation of the motor 12. Similarly, the grinding wheel 41 is movable in the Z-axis direction upon rotation of the motor 4, and is retractably advanced in the X-axis direction upon rotation of the motor 22.

Next, a machining method in a case of using the grinding machine 1 as constructed above will be explained hereinafter.

FIG. 3 shows a case grinding pin portions of the crankshaft used for a straight four-cylinder engine, and FIG. 4 shows a phase relationship between the respective pin portions therefor. Besides, a P-axis and Q-axis represent a coordinate axis perpendicular to each other in FIG. 3.

In FIGS. 3 and 4, the crankshaft 80 is to be used for the four-cylinder engine, and there are provided the journal portions 81 as a rotational axis, four pin portions 82*a*, 82*b*, 82*c* and 82*d*, and arm portions 83. The pin portions 82*a*–82*d* are rotatably connected with connecting rods of the engine (not shown), respectively. Further, the pin portions 82*a*–82*d* are fixed to the journal portions 81 through the arm portions 83, respectively.

In a machining operation of such a crankshaft 80 for the straight four-cylinder engine, the pin portions 82*a* and 82*c* are respectively ground as a first grinding process by the left- and right-side grinding wheels 31 and 41. First, a position of the grinding wheel 31 in the Z-axis direction is coincided with the pin portion 82*a* by moving the left-side Z-axis table 10 with the left-side Z-axis table motor 3. On the other hand, a position of the grinding wheel 41 in the Z-axis direction is coincided with the pin portion 82*c* by moving the right-side Z-axis table 20 with the right-side Z-axis table motor 4, at the same time. Subsequently, a movement of the left-side wheel head 30 by the left-side wheel head motor 12 in the X-axis direction is synchronously coincided with a rotation of the main spindle motor 51. Similarly, a movement of the right-side wheel head 40 by the rightside wheel head motor 22 in the X-axis direction is synchronously coincided with a rotation of the main spindle motor 51. Therefore, the pin portions 82*a* and 82*c* can be simultaneously ground by the grinding wheels 31 and 41, respectively.

In the above-mentioned situation, a rotational phase difference between the pin portions 82*a* and 82*c* is 180°, i.e., the pin portion 82*c* exists at a position represented by (b) in FIG. 9 when the pin portion 82*a* exists at a position represented by (a) in FIG. 9. Therefore, a load acting on the main spindle by a grinding resistance of the grinding wheel 31 can be canceled in a rotational direction of the main spindle by that acting thereon due to the grinding resistance of the grinding wheel 41. According to this result, a load fluctuation in the main spindle is restrained, so that a grinding accuracy on the workpicce can be improved.

Next, as a second grinding process similar to the above-described first machining process, the pin portion 82*b* is ground by the left-side grinding wheel 31, while the pin portion 82*d* is ground by the right-side grinding wheel 41. In this second grinding process, the rotational phase difference between the pin portions 82*b* and 82*d* is also 180°, so that the load acting on the main spindle by the grinding resistance of the grinding wheel can be canceled.

FIG. 5 shows a case grinding pin portions of the crankshaft used for a V-type six-cylinder engine, and FIG. 6 shows a phase relationship between the respective pin portions therefor. Besides, a P-axis and Q-axis in FIG. 6 are the same as that shown in FIG. 4.

In FIGS. 5 and 6, the crankshaft 90 is to be used for the V-type six-cylinder engine, and there are provided a journal portions 91 as a rotational axis, six pin portions 92*a*, 92*b*, 92*c*, 92*d*, 92*e* and 92*f*, and arm portions 93. The pin portions 92*a*–92*f* are rotatably connected with connecting rods of the engine (not shown), respectively. Further, the pin portions 92*a*–92*f* are fixed to the journal portions 91 through the arm portions 93, respectively. Each of the pin portions 92*a*–92*f* is arranged so that the rotational phase difference between each of the pin portions 92*a*–92*f* is 60° in turn.

In the crankshaft 90 for the V-type six-cylinder engine similar to the machining process for the straight four-cylinder engine, two of the pin portions is so selected that its rotational phase difference therebetween is 180°, and are simultaneously ground by the grinding wheels 31 and 41, respectively.

Namely, the pin portions 92*a* and 92*f* are respectively ground by the grinding wheels 31 and 41 in a first grinding process. In a second grinding process, the pin portions 92*b* and 92*d* are ground by the grinding wheels 31 and 41, respectively. Further, in a third grinding process, the pin portions 92*c* and 92*e* are ground by the grinding wheels 31 and 41, respectively. In a case that such grinding processes are performed, the load acting on the main spindle by the grinding resistance of the grinding wheel is canceled, so that the machining accuracy on the workpiece can be improved.

In the machining operations according to the aforementioned grinding processes, the pin portion 92*b* and the pin portion 92*c* adjacent thereto are simultaneously ground in the second grinding process and thereafter, the pin portion 92*d* and the pin portion 92*e* adjacent thereto are simultaneously ground in the third grinding process. According to a size (a distance in width between adjacent two pin portions) of the crankshaft, it may occur that the adjacent two pin portions cannot be simultaneously ground because of an interference between the left-side wheel head 30 and the right-side wheel head 40. With this reason, the following grinding processes may be adopted as another embodiment.

In a first grinding process, the pin portions 92*a* and 92*f* are respectively ground at the same time by the grinding wheels 31 and 41 and thereafter, the pin portions 92*b* and 92*d* are respectively ground thereby at the same time as a second grinding process. Further, the pin portions 92*c* and 92*e* are respectively ground by the grinding wheels 31 and 41 at the same time.

In this situation, the load acting on the main spindle by the grinding resistance of the grinding wheel cannot be canceled perfectly similarly to a case that simultaneously grinds the two pin portions in which its rotational phase difference therebetween is 180°. However, the two pin portions in which rotational phases are different (120°) are ground simultaneously, so that the load fluctuation acting on the main spindle by the grinding resistance of the grinding wheel can be reduced compared with a case either that only one pin portion is ground or that the two pin portions having the same rotational phase are ground simultaneously.

In this embodiment, it is explained about the machining operation for the crankshaft used in the straight four-cylinder or V-type six-cylinder engine and however, a shape of the crankshaft cannot be limited to that in this embodiment. In the other shape of the crankshaft, similar machining operations can be adopted, for example, the combination of the simultaneous machining operation may be adopted as shown in FIG. 10.

FIG. 7 shows a process table for simultaneously grinding by the grinding wheels 31 and 41 two pin portions having the different rotational phases in each variety of workpiece (workpiece No.). If such a process table is memorized in the RAM 64 beforehand, the simultaneous machining operation in the two pin portion having the different rotational phases can be automatically performed by commanding only a workpiece No.

In FIG. 7, "workpiece No. 1" and "workpiece No. 2" represent a crankshaft used in the straight four-cylinder engine and a crankshaft used in the V-type six-cylinder engine.

Further, "workpiece No. 3" represents another type of a crankshaft used in the V-type sixcylinder engine.

In "workpiece No. 1", a first pin portion (corresponding to the aforementioned pin portion 82*a* ) and a third pin portion (corresponding to the aforementioned pin portion 82*c* ) are simultaneously ground in a first grinding process. Thereafter, a second pin portion (corresponding to the aforementioned pin portion 82*b* ) and a fourth pin portion (corresponding to the aforementioned pin portion 82*d* ) are simultaneously ground in a second grinding process.

In "workpiece No. 2", a first pin portion (corresponding to the aforementioned pin portion 92*a* ) and a sixth pin portion (corresponding to the aforementioned pin portion 92*f* ) are simultaneously ground in a first grinding process Thereafter, a second pin portion (corresponding to the aforementioned pin portion 92*b* ) and a third pin portion (corresponding to the aforementioned pin portion 92*c* ) are simultaneously ground in a second grinding process. Further, a fourth pin portion (corresponding to the aforementioned pin portion 92*d* ) and a fifth pin portion (corresponding to the aforementioned pin portion 92*e* ) are simultaneously ground in a third grinding process.

In "workpiece No. 3", a first pin portion (corresponding to the aforementioned pin portion 92*a* ) and a fourth pin portion (corresponding to the aforementioned pin portion 92*f* ) are simultaneously ground in a first grinding process. Thereafter, a second pin portion (corresponding to the aforementioned pin portion 92*b* ) and a sixth pin portion (corresponding to the aforementioned pin portion 92*d* ) are simultaneously ground in a second grinding process. Further, a third pin portion (corresponding to the aforementioned pin portion 92*c* ) and a fifth pin portion (corresponding to the aforementioned pin portion 92*e* ) are simultaneously ground in a third grinding process.

The machining operation using the aforementioned process table will be explained hereinafter with reference to a flowchart shown in FIG. 8. In step S10 "workpiece No." to be machined is input and then, in step S11 a variable "N" indicative of a grinding process is set to "1".

Next, in step S12, a pin portion number to be machined in "$N^{th}$" grinding process designated in step S10 is read from the process table in FIG. 7. For example, in the first grinding process of workpiece No. 1, the pin portion number "L=1" and "M=3" are read.

Thereafter, in step S13, the left-side wheel head 30 is moved by the left-side Z-axis table motor 3 so that the grinding wheel 3 1 is indexed at the front of the first pin portion (corresponding to the aforementioned pin portion 82*a* ). Similarly, the right-side wheel head 40 is moved by the right-side Z-axis table motor 4 so that the grinding wheel 41 is indexed at the front of the third pin portion (corresponding to the aforementioned pin portion 82*c* ).

In step S14, profile data (data indicating a position of the wheel head relative to a rotational angle of the main spindle to synchronize a advance-and-retractive movement of the wheel head to a rotation of the main spindle) is read from the RAM 64 in order to grind each of the pin portions. Thereafter, the two pin portions are simultaneously ground based upon this read profile data. In step S17, "N" is counted up (incremented by "1"). The aforementioned steps are repeated until it is judged such a last grinding process in step S16.

Obviously, numerous modifications and variations of the present invention are possible in light of the above teachings. It is therefore to be understood that within the scope of the appended claims, the present invention may be practiced otherwise than as specifically described herein.

What is claimed is:

1. A machine tool for simultaneously grinding two pin portions of a rotating crankshaft, comprising:

a bed;

a main spindle and a tailstock mounted on said bed, that rotatably support the crankshaft around a center axis of journal portions of the crankshaft as a rotational axis;

a first table movably provided on said bed in a first direction parallel to the rotational axis of the crankshaft;

a first wheel head movably provided on said bed in a second direction perpendicular to the first direction, that supports a first grinding wheel;

a second table movably provided on said bed in the first direction;

a second wheel head movably provided on said bed in the second direction, that supports a second grinding wheel;

a numerical control unit that respectively controls relative motions between a rotation of the crankshaft and a movement of said first wheel head and between the rotation of the crankshaft and a movement of said second wheel head;

a memory provided in said numerical control unit, that stores pin portion data as a combination of the two pin portions to be simultaneously ground whose rotational phase are different from each other;

a table memorized in said memory, that stores a corresponding relationship between the pin portion data and a variety of the crankshafts; and designation means for designating one of the crankshafts to be machined, wherein the respective two pin portions of the designated rotating crankshaft are simultaneously ground by said first and second grinding wheels in accordance with the pin portion data stored in said memory.

2. A machine tool according to claim 1, wherein a difference between the two pin portions to be simultaneously ground having the different rotational phases is 180°.

3. A machine tool according to claim 1, wherein a difference between the two pin portions to be simultaneously ground having the different rotational phases is 120°.

* * * * *